United States Patent [19]

Sasakawa et al.

[11] Patent Number: 5,042,807

[45] Date of Patent: Aug. 27, 1991

[54] BOXER DOLL AND BOXING GAME APPARATUS EMPLOYING SAME

[75] Inventors: Koichi Sasakawa; Yoshiaki Funakoshi, both of Tokyo, Japan

[73] Assignee: Tomy Company, Ltd., Tokyo, Japan

[21] Appl. No.: 516,706

[22] Filed: Apr. 30, 1990

[30] Foreign Application Priority Data

May 22, 1989 [JP] Japan ..... 1-128364

[51] Int. Cl.[5] ..... A63F 9/00; A63H 13/06

[52] U.S. Cl. ..... 273/85 C; 273/85 E; 273/85 H; 446/334; 446/198

[58] Field of Search ..... 273/85 B, 85 D, 85 E, 273/85 H, 129 T, 129 W, 129 AP, 85 R, 85 C; 446/330, 333, 334, 335, 197, 198

[56] References Cited

U.S. PATENT DOCUMENTS

| | | | |
|---|---|---|---|
| 1,605,738 | 11/1926 | Idemoto | 446/198 |
| 2,131,496 | 9/1938 | Auger | 446/198 |
| 2,760,306 | 8/1956 | Pelletier | 446/334 |
| 3,845,956 | 11/1974 | Goldfarb et al. | 273/85 H X |
| 3,848,357 | 11/1974 | Morrison | 446/334 X |
| 3,856,304 | 12/1974 | Matsumoto et al. | 446/334 X |
| 3,997,157 | 12/1976 | Meyer | 446/197 X |
| 4,031,657 | 6/1977 | Crossman et al. | 446/334 X |
| 4,091,563 | 5/1978 | Noble et al. | 446/334 |
| 4,367,875 | 1/1983 | Barlow et al. | 446/334 X |
| 4,609,195 | 9/1986 | Ham | 446/198 X |

FOREIGN PATENT DOCUMENTS

| | | | |
|---|---|---|---|
| 614344 | 12/1926 | France | 446/334 |
| 765875 | 6/1934 | France | 446/334 |
| 857511 | 9/1940 | France | 273/85 H |
| 1130472 | 2/1957 | France | 446/334 |
| 1134041 | 4/1957 | France | 446/334 |
| 436524 | 10/1935 | United Kingdom . | |
| 1456357 | 11/1976 | United Kingdom | 446/334 |

*Primary Examiner*—Edward M. Coven
*Assistant Examiner*—Sebastiano Passaniti
*Attorney, Agent, or Firm*—Staas & Halsey

[57] ABSTRACT

A boxer doll has at least one articulate arm rotatably pivoted on a shaft provided in a shoulder portion of the body, and a pneumatic actuator operatively connected to the at least one articulate arm. An air supply tube has an inner end portion connected to the pneumatic actuator and an outer end portion, and a glove corresponding to the at least one articulate arm and being movable by a player is connected to the outer end portion of said air supply tube. An inertial pump disposed in said glove is connected through said air supply tube to said pneumatic actuator, for driving the pneumatic actuator in accordance with movements of the glove initiated by the player.

19 Claims, 5 Drawing Sheets

BOXER DOLL AND BOXING GAME APPARATUS EMPLOYING SAME

BACKGROUND OF THE INVENTION

1. Field of the Invention

The present invention relates to a boxing game apparatus provided with a boxer doll which is structured to punch with an articulate arm, in which two players use boxing gloves to move respective boxer dolls opposing each other, either of which can be knocked down by the other on deliver of a punch of sufficient force.

2. Description of the Related Art

Many different types of boxer dolls and boxing games are presently known. Conventionally, boxer dolls have two articulate arms which are operated by corresponding push buttons.

The conventional boxer dolls and boxing games are played by players who push the push buttons to throw punches at the opposing boxer doll. Therefore, conventional devices have the disadvantage that they do not provide a realistic emulation of the actual sport of boxing, since the action of pushing a button is completely divorced from the action undertaken in the sport.

SUMMARY OF THE INVENTION

An object of the present invention is to provide a more realistic emulation of the sport of boxing than what is available in conventional, push-button-type boxing games.

The present invention achieves the above and other objects by providing a boxer doll and game which includes pump means disposed in a glove to be held by a player. When the player boxes by holding the glove, an actuator, such as a bellows, mounted in the body of the doll extends in accordance with the pump means to rotate the articulate arm with its driving force. The boxer dolls are arranged to face each other on the base and are provided with a head mounted swingably in the front and rear direction. A lever pivotally mounting the head is connected with engage means provided on the base for the doll through link means. When the head is swung to a rear direction by a punch delivered by the arm of the opposing boxer, the punched boxer doll is knocked down rearwardly on releasing the engagement between the base and the stage by the operation of the engage means connected to the head through the link means.

On initiating boxing action by holding the glove, the player operates the pump means in the glove which supplies air to the bellows in the body of the boxer which is connected to the pump means with an air supply tube. Then, the bellows is extended by the drive force to operate the articulate arm. The boxer dolls are arranged on the base to oppose each other, and the articulate arms of the boxer doll are operated by the players holding and moving the gloves as if throwing punches. When the articulate arm hits the head of opposing boxer, the stricken boxer falls down to the rear side on releasing the engagement between the stage of boxer dolls and the base. Thereby, the "knockdown" action of a boxer is emulated.

DETAILED DESCRIPTION OF THE PREFERRED EMBODIMENTS

Figure 1:
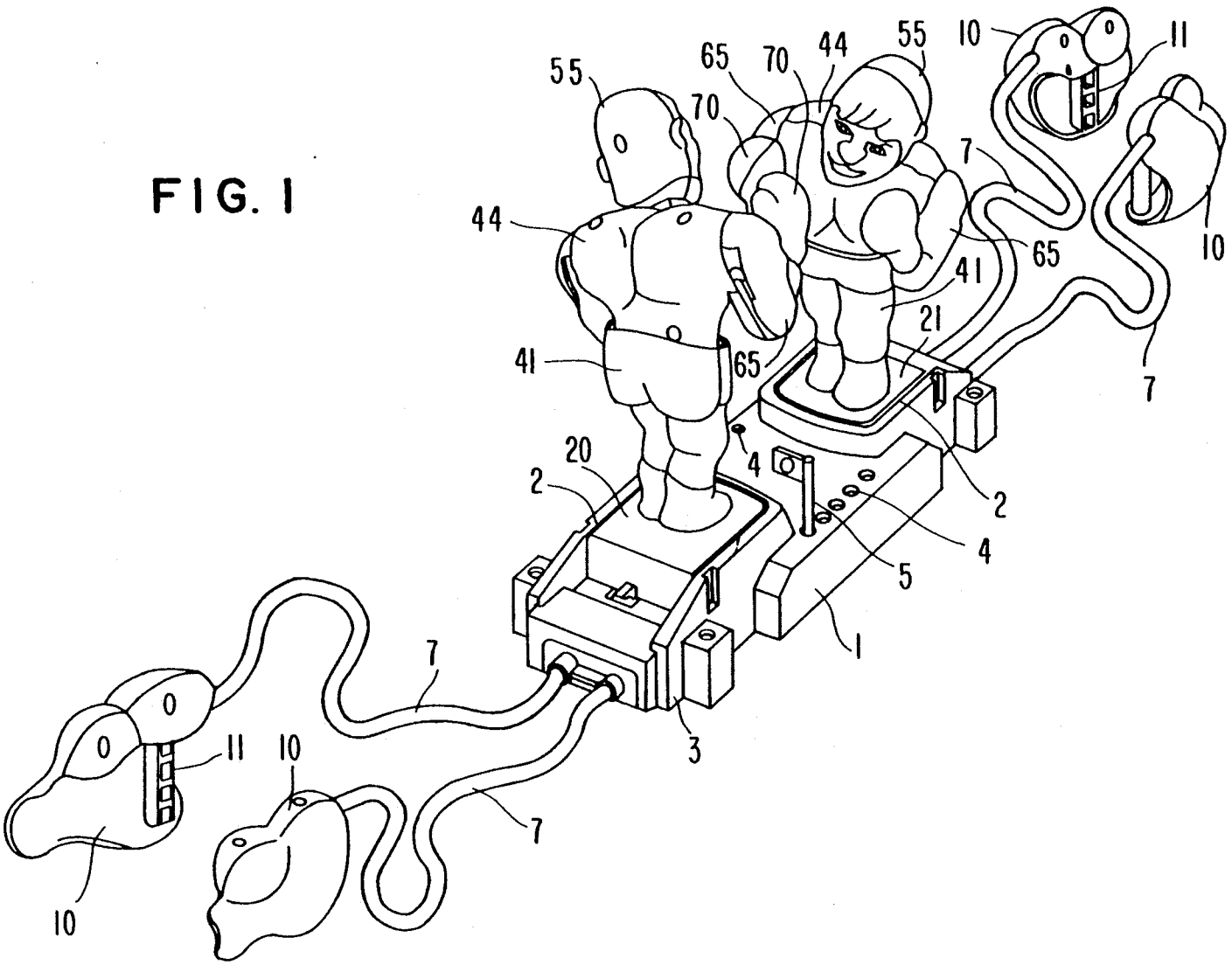
FIG. 1 is a perspective view showing an appearance of the boxing game apparatus according to the present invention.

FIG. 1 is a perspective view showing a boxing game apparatus according to the present invention. Stages 20, 20 are detachably mounted on concave portions 2, 2 formed on an upper portion of a base 1. Each of two boxer dolls is provided with a leg portion 41, a torso portion 44 and a head 55. The dolls are upstanding from the upper portion of the stage 20. Articulate arms are formed with an upper arm portion 65 and a lower arm portion 70 pivotally connected thereto at an elbow, with the upper arm portion being pivotally connected to the shoulders of the torso portion 44. Connectors 3, 3 are plugged into opposite ends of the base 2, and are connected with the end portions of air supply tubes 7. The gloves 10 are connected to the outer end of the air supply tubes 7. A plurality of holes 4 are formed along the opposite sides of the upper portion of the base 1 to detachably mount a flag 5. The flag 5 is used for indicating the number of knockdowns of the opponent.

Figure 7:
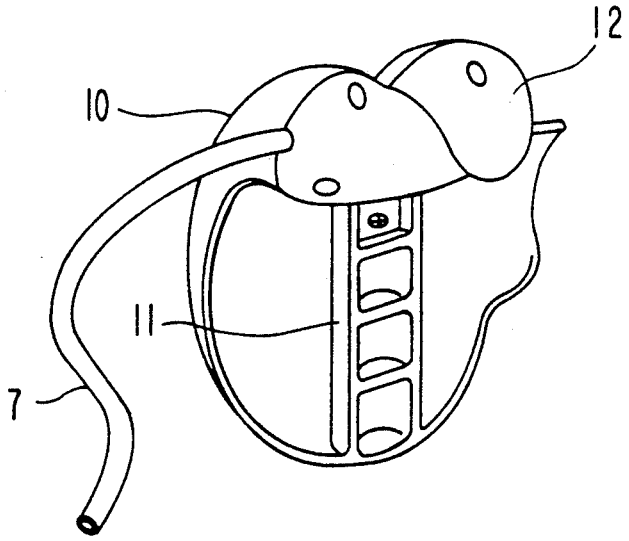
FIG. 7 is a perspective view showing the glove.
Figure 8:
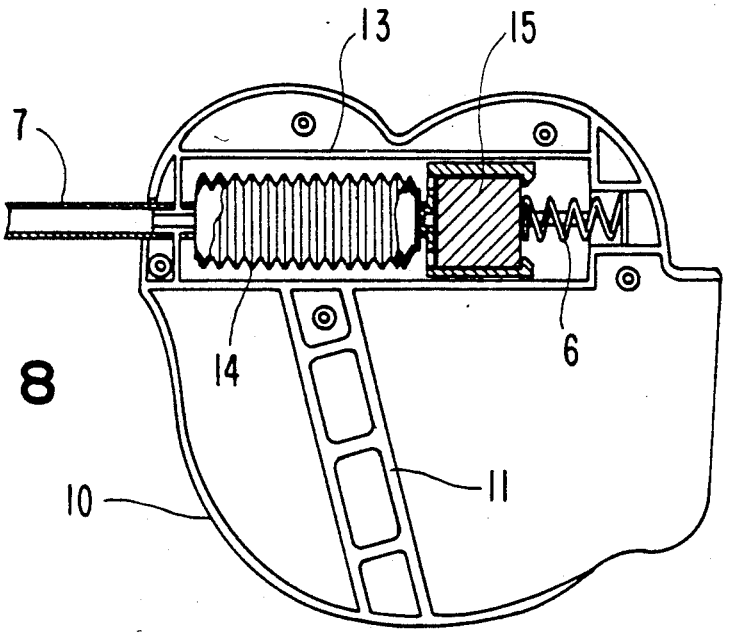
FIG. 8 is a partially sectional view thereof.

As shown in FIGS. 7 and 8, a glove 10 is formed to emulate a boxing glove, and has a somewhat semi-spherical shape, and has a cover 12 mounted thereon. FIG. 8 shows the inner construction on removing the cover 12. A bellows 14 is stored in a cylindrical guide 13. The bellows 14 is molded to be hollow and is made of elastic synthetic resin. The bellows has a corrugated side wall to facilitate extension, and one end portion thereof is connected to the outer end portion of air supply tube 7. A weight 15 slidably disposed in the guide member 13 is connected to the other end portion of the bellows 14. A push spring 16 is connected to and extends between the end face of weight 15 and a recess at one end of guide 13. The bellows 14 also has a spring force in the extended position so as to have the same force as the push spring. A stick type arm 11 is formed between the cylindrical guide 13 and the outer casing of the glove 10. Four gloves are provided with the pump means having above mentioned bellows 14 and the weight 15. The player can play boxing by holding in both hands a pair of gloves 10. When the glove 10 is thrust forward, the weight 15 in the cylindrical guide 13 moves forwardly to press the bellows 14, so that air in the bellows 14 is compressed and supplied to the air supply tube 7. When the glove 10 is pulled back, the weight 15 returns to the right direction in FIG. 8 by its weight and the spring force of the bellows 14. The push spring 16 functions as a shock absorber to prevent the weight 15 from hitting against the end of the cylindrical guide 13. Thus, the bellows 14 and weight 15 constitute an inertial pump for generating a motive fluid which drives the articulate arms.

Figure 2:
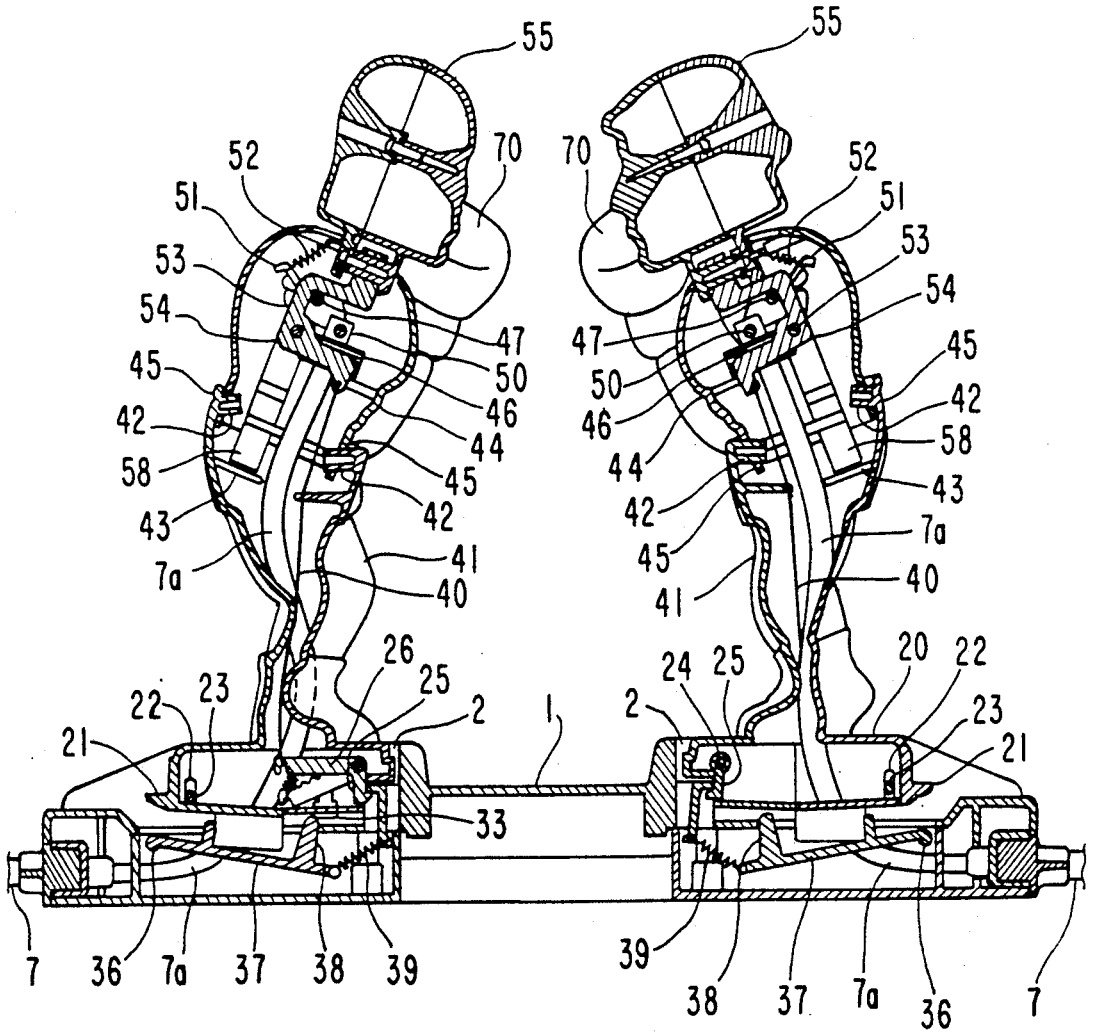
FIG. 2 is a longitudinal sectional view thereof.
Figure 3:
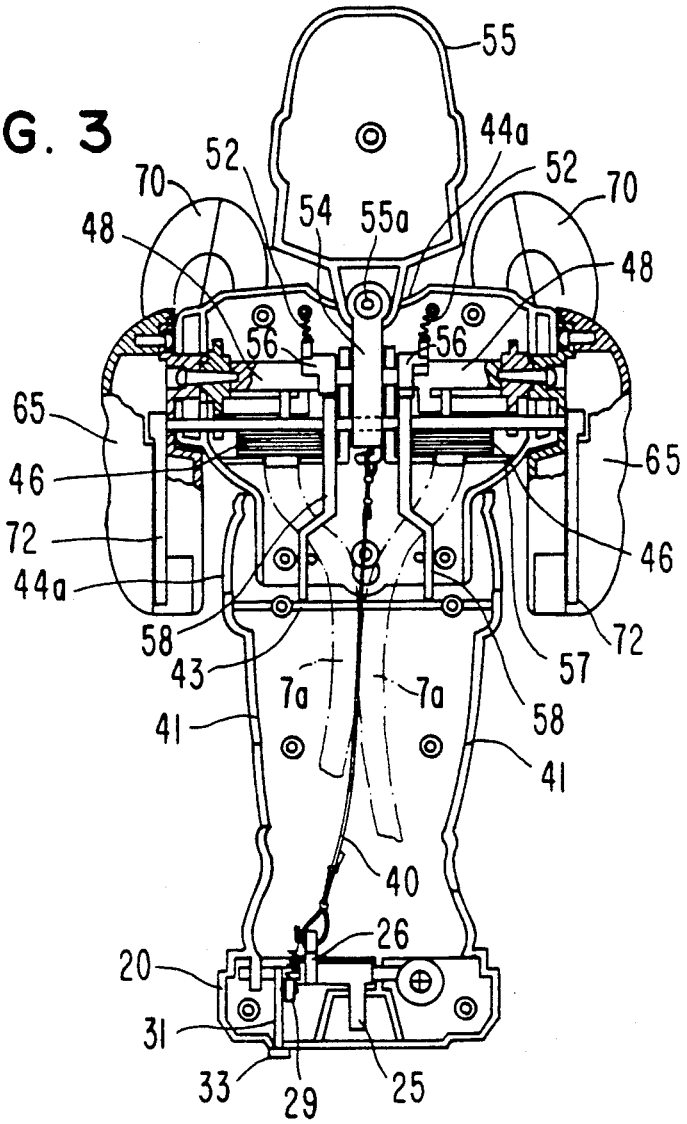
FIG. 3 is a partial sectional view showing an internal construction of the boxer doll according to the present invention.
Figure 4:
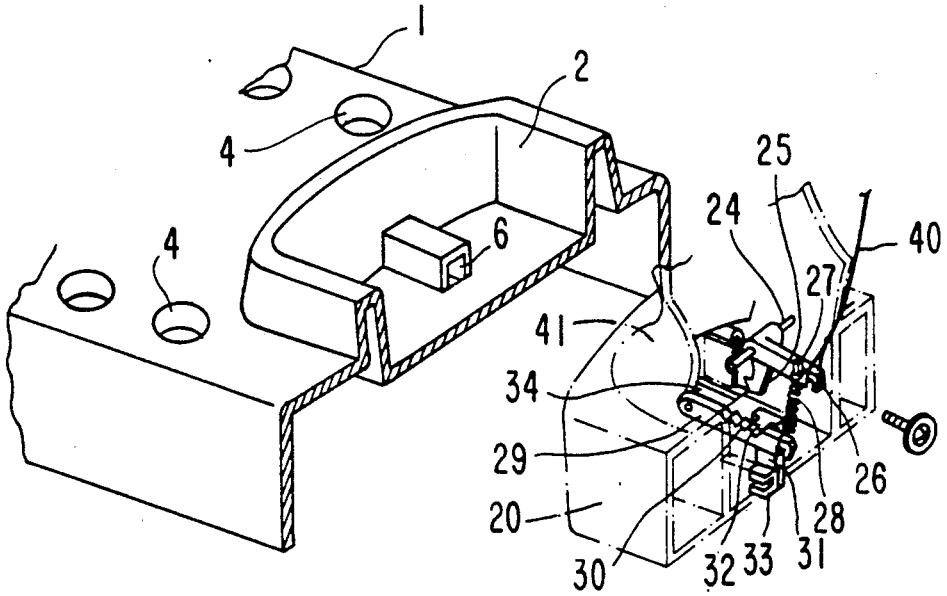
FIG. 4 is a perspective view showing the relation between the base and the stage.
Figure 5:
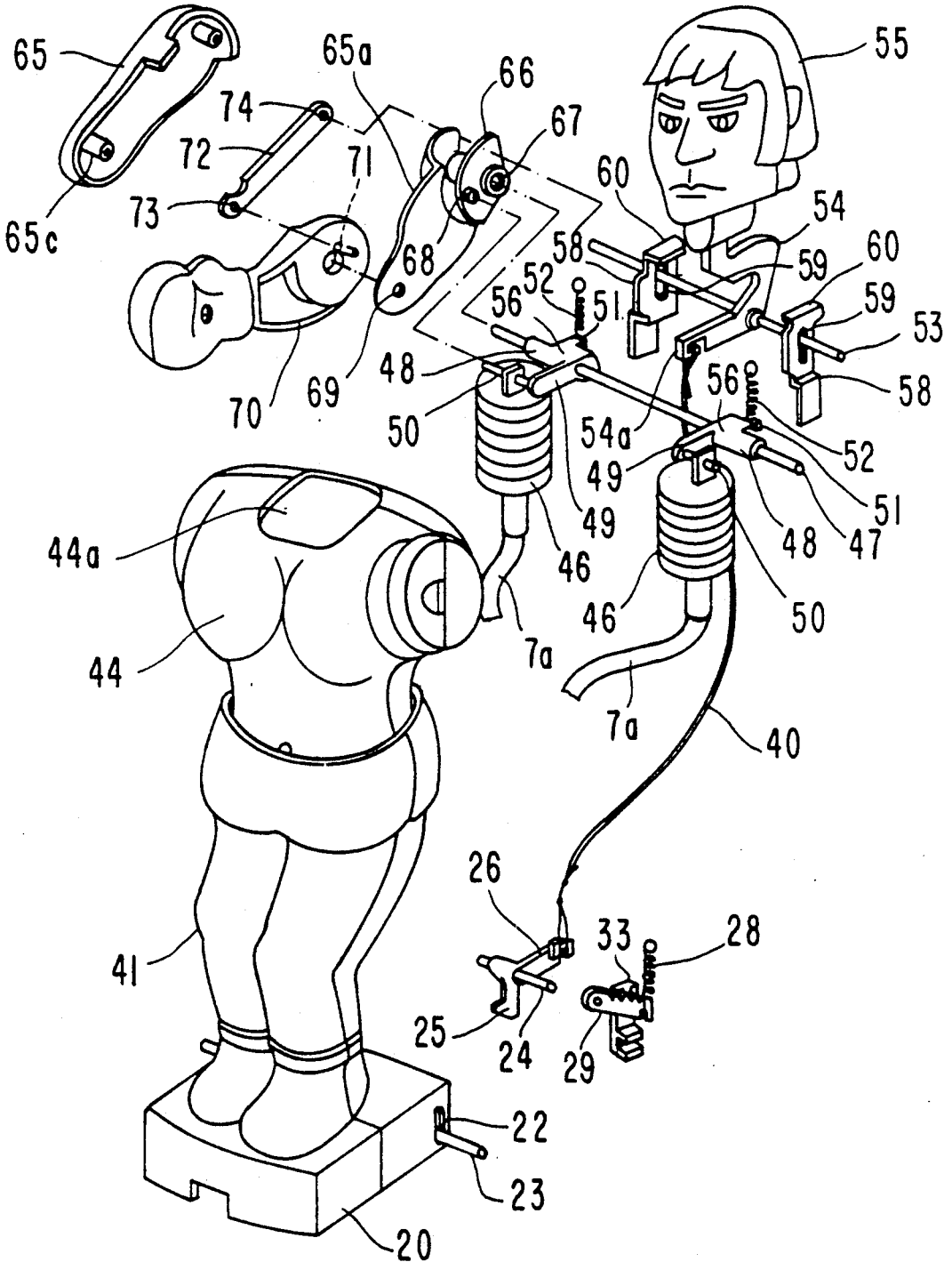
FIG. 5 is an exploded perspective view showing an internal construction of the boxer doll.

The construction of the boxer doll is shown in FIGS. 2, 3 and 5. The leg portion 41 is arranged on the upper portion of the stage 20. A pair of support shafts 42, 42 are provided at front and rear sides of the body in the inner portion thereof corresponding to a waist portion between the body and leg portions. The support shafts 42, 42 are received in corresponding bearing holes 45, 45 formed in lower front and rear positions of the torso portion 44. The torso portion 44 is supported for swiveling movement by using the support shafts 42, 42 as the swivel point.

A support shaft 47 is provided on an upper side of the torso portion 44 corresponding to a shoulder position. Opposite end portions of the support shaft 47 are required in holes 67, 67 of a pair of articulate arms formed by the lower arm portions 70, 70 and the upper arm portions 65, 65. Pivotal levers 48, 48 are pivotally mounted on intermediate portions of the support shaft 47, and are provided with projecting portions 49, 49. Pins 50, 50 are arranged on the top end of projecting portions 49, 49, and are engaged with the upper end portion of bellows 46, 46. The bellows 46, 46 are hollow and made of elastic synthetic resin. Each has a corrugated periphery (refer to FIG. 5) similar to bellows 14. Internal portions *7a, 7a* of the air supply tubes 7, 7 are connected to the lower end of the bellows 46, 46. Projecting portions 56, 56 of the pivot levers 48, 48 extend to the projecting portions 49, 49. Tabs 51, 51 are formed on the projecting portions 56, 56, and tension springs 52, 52 are provided between the tabs 56, 56 and the torso portion 44. A lower end of the bellows is connected to a partition board 57. Therefore, in the normal condition, the bellows 46, 46 are retracted to the partition board 57 formed in the torso portion 44 as shown in FIG. 3, with the upper end of the bellows being pushed downwardly by the projecting portions 49, 49 which pivot in counter-clockwise direction shown in FIG. 5 in accordance with the pulling force of the springs 52, 52. The lower portion 70 of the articulate arm 70 is angled towards the upper arm portion 65 at this time, as shown in FIG. 6.

The articulate arm includes the upper and lower arm portions 70. A proximal end of the lower arm portion 70 is pivotally connected to a distal end of the upper arm portion 65 through a side plate **65*a* of the upper arm portion 65. A pin 71 is arranged in an eccentric position on the proximal end of lower arm portion 70. The pin 71 is engaged freely with the through hole 73 of a linkage 72. A fan-shaped support plate 66 fixed with the side plate 65*a* of the upper arm portion 65 is formed with a shaft hole 67 at the pivoted portion in the upper arm portion 65. The pin 50 projected from the projecting portion 49 is engaged with the through hole 68 formed in the eccentric position relative to the shaft hole 67. The support shaft 53 is arranged below the support shaft 47. Both ends of the support shaft 53 are arranged freely with the through holes 74, 74 of the linkage 72 while projecting between opposite sides of the torso portion 44. In the boxer doll provided with the basic structure mentioned above, compressed air is supplied to the bellows 46, 46** through the internal portions *7a* of air supply tubes 7, by operation of the bellows 14 provided in the gloves 10 when the player acts to punch as if boxing on holding the glove 10. The bellows 46, 46 which are inflated with air drive the pivotal levers 48, 48 rotatably in the clockwise direction shown in FIG. 5 against the pulling force of the springs 52, 52. The support plate 66 engaged with the pins 50, 50 rotates in the clockwise direction shown in FIG. 5, the waist portion being lower than the upper arm portions 65, 65, thus causing upper arm portion 65 to rotate about shaft 47. The lower arm portions 70, 70 are pivotally connected to the upper arm portions 65, 65 by means of a boss **65*c*, and the link members 72, 72 are pivotally connected at one end to pins 71** provided on the lower arm portions.

Figure 6:
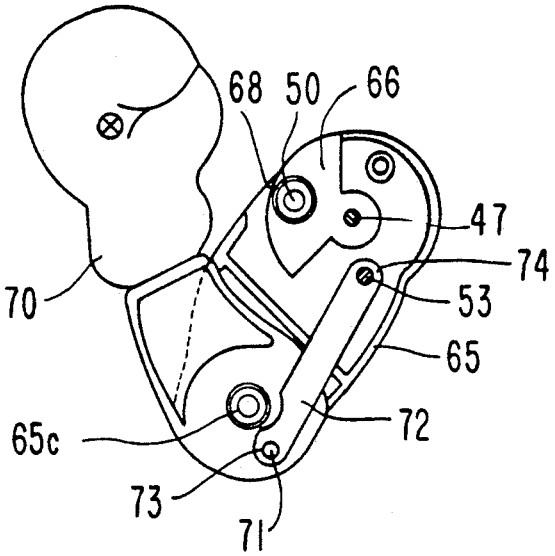
FIG. 6 is a side view of the articulate arm.

Arm extension, as required in boxing, is effected when the upper arm portion 65 pivots clockwise, as seen in FIG. 6, due to the bellows 46 lifting projecting portion 49 upwardly. While the distance between the pivot axis of boss **65*c* and shaft 47 is fixed, the distance between the pivot axis of boss 65*c* and the pivot axis of shaft 53 increases as the upper arm portion 65 rotates clockwise. Since pin 71 and shaft 53 are linked together through linkage 72, the lower arm portion 70 is caused to rotate counter-clockwise, when the upper arm rotates clockwise, thus articulating the arm into an extended-straight position (or towards such a position). This articulation resembles a "jab" punch in the sport of boxing. Thus, the action of punching can be controlled in its strength in accordance with the action of the glove 10**. Therefore, defensive and offensive moves can be performed by controlling the speed and strength of the punches.

A head support lever 54 is pivotally connected to an intermediate portion of the support shaft 53. The head 55 is movable side-to-side and fore-and-aft with the aid of a pivot portion **55*a* on the top end of the lever 54 (refer to FIGS. 3 and 5). Namely, the head 55 projects from an opening 44*a* formed on the upper portion of torso portion 44, and is swivel-movable in the front and rear directions and the right and left directions relative to the torso portion 44. The lever 54 has an end portion 54*a* which engages the upper end of link means 40 formed of a cable or a rod. Slide plates 58, 58 are arranged to engage an upper surface of a plate 43 formed transversely in the waist portion 44 when upper end flanges 60, 60 thereof contact the lower end face of the projecting portions 56, 56 of the levers 48, 48. The support shaft 53 passes through slots 59, 59 formed in the slide plates 58, 58 thus sliding of the slide plates 58, 58 in the upper and lower directions can be facilitated. The slide plates 58, 58 are used for moving the waist portion 44*a* in the horizontal direction when the boxer doll acts to punch. As shown in FIG. 3, when the right hand punch is initiated, the right side slide plate 58 is pressed by the right side projecting portion 56 of lever 48 so as to be moved downwardly. This causes the torso portion 44 to tilt to the left, as the right hand projecting portion pushes off the upper end of the side plate 51. Thus, the waist portion 44*a* is pivoted to the left direction on the support shafts 42, 42. When the left hand punch is initiated, the left side slide plate 58 is operated to move the waist portion 44*a*** to be inclined in the right hand direction.

As shown in FIG. 2, the stages 20, 20 formed integrally with the legs 41, 41 are arranged on the base 1 to be received in the concave portions 2, 2. On the rear portion of the stages 20, 20, vertically disposed slots 22 are formed. Support shafts 23, 23 pivotally connected at opposite end portions to the base 1 are engaged through the slots 22. On the front portion of each stage 20, a support shaft 24 pivotally carries a latch 26 having a hooked arm 25. The lower end of the link means 40 is connected to the other arm of the latch 26. The hooked arm 25 projects from the front portion of the through hole 34 formed in the bottom portion of each stage 20, and is provided detachably with the hole 6 formed in the base 1. A tab 27 is formed at the upper arm of the latch 26, and engages an end portion of a spring 28. The other end portion of the spring 28 is engaged with the top end of a slide lever 29. The slide lever 29 is pivotally and slidably mounted on the stage 20, and has a plurality of teeth 30 on its upper surface. The slide lever 31 is provided with a hook 32 engageable with the teeth 30 and is slidably engaged in a groove formed in the bottom portion of stage 20. The lower end of the slide lever 31 is provided to project from the bottom portion of the stage 20 to facilitate manipulation and operation from outside. The mechanism mentioned above is used for controlling the tension of the link means. When the slide lever 31 is moved to the distal end portion of the slide lever 29, the distal end of the slide lever 29 lowers, thereby the tension of the link means is strengthened by extending the spring 28. Therefore, the engage hook 25 can be strongly engaged with the engage hole 6.

An elastic member 36 is rotatably provided in the base 1 of the lower side of stage 20 pivotally on a support shaft 36. A spring 39 is arranged between the top end of the elastic member 36 and the base 1, and a projection 38 is arranged on the upper surface of the elastic member 36. The top end of the projection 38 is contacted with the center portion of the bottom of the stage 20, and the front portion of the stage 20 is urged strongly upwardly by the force of spring 39. The spring 39 cause the doll to fall rearwardly when the engagement between the base and stage is released. Further, a projection 21 is provided on the rear end portion of the stage 20, and acts as a shock absorber on engaging with the elastic member 37 when the boxer doll is knocked down to the rear side.

The stage 2 of each boxes doll is usually inclined either right or left direction, because it is supported at the point with the projection 38 its center portion of bottom. When the punch of one boxer doll hits the head 55 of the other, and the head 55 is swung to rear side, the engage hook 25 connected to the link means 40 is pivoted. When the engagement of the hooked end 25 with the engage hole is released, the front portion of the stage 20 provided with the boxer doll is rotated upwardly by the force of elastic member 37, thereby the boxer is knocked down to the rear side to simulate a "knockdown" in the sport of boxing. The boxer doll provided with the mechanisms as mentioned above, is able to punch right and left, alternately to cause the waist portion to swivel or pivot about a substantially horizontal axis, thereby the punch of opponent can be eluded.

The present invention is constructed as described above. When the player holds the glove having therein the pump means and acts to punch as boxing, the articulate arm of the boxer doll connected to the pump means acts to punch corresponding to the punching action of the glove as initiated by the player. Thus, the boxer doll simulates real boxing, which is not found in the conventional boxer doll and games.

Further, the present boxing game apparatus provides that the player can hold the gloves to play boxing to act the boxer dolls, and the boxer doll can be knocked down when the punch of opponent boxer land a good hit. Thus, a more thrilling boxing game can be played in which a proper movement of boxing can be obtained.

What is claimed:

1. A boxer doll, comprising:

a body;

at least one articulate arm rotatably and pivotally mounted on a shaft provided in a shoulder portion of the body;

a pneumatic actuator operatively connected to the at least one articulate arm;

an air supply tube having an outer end portion and an inner end portion connected to the pneumatic actuator;

a glove adapted to be held in the hands of a player and corresponding to the at least one articulate arm and being movable by a player and being connected to the outer end portion of said air supply tube; and pump means disposed in said glove and being connected through said air supply tube to said pneumatic actuator, for driving the pneumatic actuator in accordance with translating movements of the glove initiated by the player while the glove is being held in the handle.

2. A boxing game apparatus, comprising:

a pair of boxer dolls, each having a support stage;

a base releasably mounting the stages with the boxer dolls opposing each other;

means for releasably holding said base to said pair of stages;

means disposed in said base, for biasing upwardly a front portion of each stage;

wherein said boxer doll comprises a pair of articulate arms rotatably pivoted on a shaft provided in a should portion, a pneumatic actuator operatively connected to the pair of articulate arms, an air supply tube having an inner end portion connected to the pneumatic actuator and an outer end portion, a glove adapted to be held in the hands of a player and corresponding to the pair of articulate arms and being movable by a player and connected to the outer end portion of said air supply tube, pump means disposed in said glove and being connected through said air supply tube to said pneumatic actuator for driving the pneumatic actuator in accordance with translating movements of the glove initiated by the player while the glove is being held in the hand, a head provided on a top end of a rotation member pivoted on a body of said doll, said rotation member being connected with an engage means through link means, said engage means being released when said head is rotated to a rear side of said doll to allow said doll to be knocked down rearwardly.

3. A boxer doll operable by a player, comprising:

a body:

at least one articulate arm movably connected to the body:

a fluid actuator disposed within the body and being operatively connected to the at least one arm; and generating means coupled to the fluid actuator and held by the player for generating a motive fluid in the fluid actuator in response to translating hand movements of the player, thereby articulating the arm, wherein the generating means is an inertial pump having an inertially movable weight.

4. A boxer doll according to claim 3, wherein the at least one articulate arm includes an upper arm portion having a distal end and a proximal end, the proximal end being pivotally connected to the body at a shoulder portion thereof, and a lower arm portion having a distal end and a proximal end, the proximal end of the lower arm portion being pivotally connected to the distal end of the upper arm portion.

5. A boxer doll according to claim 4, wherein the at least one articulate arm further includes a linkage having one end pivotally connected to the lower arm portion and an opposite end pivotally connected to the body, whereby rotation of the upper arm portion in one direction imparts rotation of the lower arm portion in an opposite direction.

6. A boxer doll according to claim 5, wherein the fluid actuator rotates the upper arm portion of the at least one articulate arm.

7. A boxer doll according to claim 6, wherein the fluid actuator is a pneumatic actuator, and the motive fluid generated by the generating means is air.

8. A boxer doll according to claim 7, wherein the pneumatic actuator is a bellows having one end connected to the at least one articulate arm.

9. A boxer doll according to claim 3, wherein the fluid actuator is a pneumatic actuator, and the motive fluid generated by the generating means is air.

10. A boxer doll according to claim 9, wherein the pneumatic actuator is a bellows having one end connected to the at least one articulate arm.

11. A boxer doll according to claim 3, wherein the inertial pump reciprocates a bellows.

12. A boxer doll according to claim 3, further comprising a base for releasably supporting the body, and wherein the body has a stage and a movable head, and wherein the stage includes releasable means for holding the body upright on the base.

13. A boxer doll according to claim 12, wherein the releasable means is operatively connected to the head through link means, the releasable means being actuated to release the body from the base.

14. A boxer doll according to claim 13, further comprising means for adjusting the amount of force necessary to actuate the releasable means.

15. A boxer doll according to claim 13, wherein the releasable means comprises a latch disposed in a forward portion of the stage, a catch disposed in a corresponding portion of the base to receive the latch, wherein the latch is connected to the head through the link means.

16. A boxer doll according to claim 15, wherein the head is mounted pivotally on a lever, and wherein the link means comprises a cable extending between the head mounting lever and the latch.

17. A boxer doll according to claim 3, wherein the body includes a leg portion and a torso portion pivotally connected to the leg portion at a waist portion, and the boxer doll further comprises means disposed in the body for tilting the torso portion when the at least one articulate arm is articulated.

18. A boxer doll according to claim 3, wherein the boxer doll has two articulate arms.

19. A boxing game comprising:

a pair of boxer dolls;

a base for supporting the pair of boxer dolls; and means for releasably holding the pair of boxer dolls to the base, wherein each boxer doll comprises:

at least one articulate arm movably connected to the body, a fluid actuator disposed within the body and being operatively connected to the at least one arm, and generating means coupled to the fluid actuator and held by the player for generating a motive fluid in the fluid actuator in response to translating hand movements of the player, thereby articulating the arm, wherein the generating means comprises an inertial pump having a movable weight.

* * * * *